United States Patent [19]

Mowbray

[11] 4,362,141

[45] Dec. 7, 1982

[54] FUEL INJECTION PUMPING APPARATUS

[75] Inventor: Dorian F. Mowbray, Burnham, England

[73] Assignee: Lucas Industries Limited, Birmingham, England

[21] Appl. No.: 228,785

[22] Filed: Jan. 27, 1981

[30] Foreign Application Priority Data

Feb. 16, 1980 [GB] United Kingdom ..... 8005311
Dec. 31, 1980 [GB] United Kingdom ..... 8041538

[51] Int. Cl.[3] ..... F02M 39/00

[52] U.S. Cl. ..... 123/449; 123/502; 123/450

[58] Field of Search ..... 123/450, 449, 502

[56] References Cited

U.S. PATENT DOCUMENTS

| | | | |
|---|---|---|---|
| Re. 23,889 | 10/1954 | Seaver | 123/450 |
| 3,485,225 | 12/1969 | Bailey et al. | 123/450 |
| 3,752,138 | 8/1973 | Gaines | 123/450 |
| 4,041,919 | 8/1977 | Bonin | 123/502 |
| 4,184,465 | 1/1980 | Nakazeki et al. | 123/450 |
| 4,200,074 | 4/1980 | Kosuda et al. | 123/450 |
| 4,220,128 | 9/1980 | Kobayashi | 123/449 |

FOREIGN PATENT DOCUMENTS

| | | | |
|---|---|---|---|
| 210211 | 12/1959 | Austria | 123/450 |
| 799111 | 7/1958 | United Kingdom | 123/450 |
| 2037365A | 7/1980 | United Kingdom | 123/450 |

*Primary Examiner*—Charles J. Myhre
*Assistant Examiner*—Magdalen Moy

[57] ABSTRACT

A fuel injection pumping apparatus includes an axially movable distributor member which carries pumping plungers movable inwardly to effect delivery of fuel by means of cam lobes formed on a cam ring. The axial position of the distributor member determines the amount of fuel supplied by the apparatus each time the plungers are moved inwardly. The distributor member is moved axially by varying the volume of liquid in a chamber, the distributor member moving as the volume of liquid increases against the action of a spring. The volume of liquid is controlled by means of a sleeve axially movable by means of a governor mechanism which includes weights. The sleeve controls the size of a port which communicates with the chamber and liquid is supplied to the chamber through a passage from a supply pump.

16 Claims, 4 Drawing Figures

FUEL INJECTION PUMPING APPARATUS

This invention relates to a fuel injection pumping apparatus for supplying fuel to an internal combustion engine and comprising a body part, a rotary distributor member located in the body part, an outwardly extending bore formed in the distributor member and a plunger located therein, means for feeding fuel to said bore to move the plunger outwardly during a filling stroke of the apparatus, a delivery passage communicating with the bore and arranged to register with an outlet port in the body part during a delivery stroke of the apparatus, a cam for imparting inward movement to the plunger to effect delivery of fuel, stop means for limiting the outward movement of the plunger and means for varying the axial setting of the distributor member, said stop means being arranged so that the amount of fuel delivered during the delivery stroke depends upon the axial setting of the distributor member.

The object of the invention is to provide an apparatus of the kind specified in a simple and convenient form.

According to the invention an apparatus of the kind specified comprises resilient means for biassing the distributor member in one axial direction, a variable volume chamber defined in part by an end face of the distributor member or a further member movable therewith, said resilient means acting to urge the distributor member in a direction to reduce the volume of said chamber, an axially movable sleeve carried on one of said members, said sleeve in conjunction with passage means in the one member which communicates with said chamber, acting to control the volume of liquid in said chamber and governor means operable to adjust the axial position of said sleeve.

One example of the fuel injection pumping apparatus in accordance with the invention will now be described with reference to the accompanying drawings in which.

Figure 1:
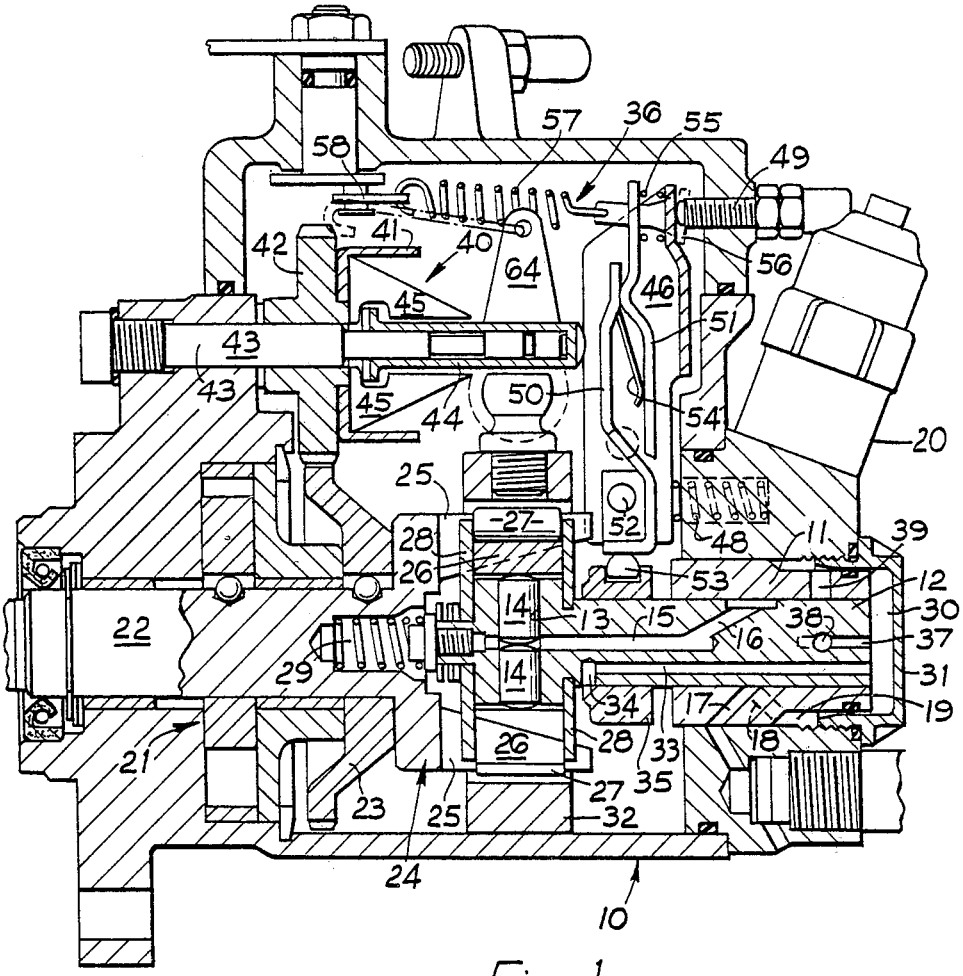
FIG. 1 is a sectional side elevation of the apparatus.
Figure 2:
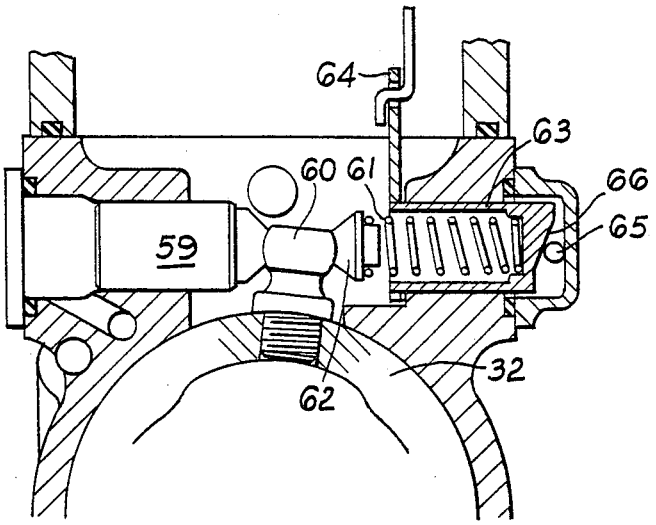
FIG. 2 is a section through part of the apparatus seen in FIG. 1 with parts removed for the sake of clarity.
Figure 3:
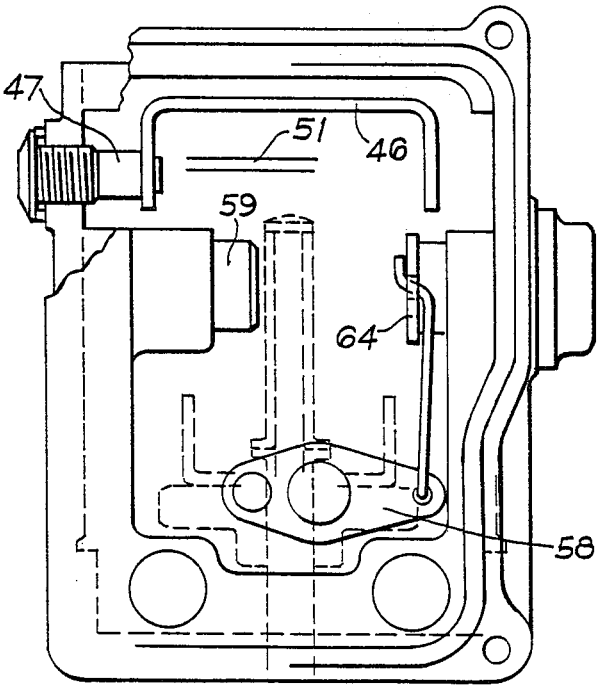
FIG. 3 is a plan view of part of the apparatus seen in FIG. 1 again with parts removed for the sake of clarity.

Referring to FIGS. 1, 2 and 3 of the drawings the apparatus comprises a multi-part body 10 which includes a sleeve 11 in which is mounted a rotary cylindrical distributor member 12. The distributor member 12 projects from the sleeve 11 and is provided with an outwardly extending through bore 13 in which is mounted a pair of plungers 14. The bore 13 communicates with an axial passage 15 formed in the distributor member and which connects with a delivery passage 16 terminating on the periphery of the distributor member in an axial groove. The groove registers in turn and as the distributor member rotates, with outlet ports 17 which in use, are connected to the injection nozzles respectively of the associated engine and with inlet passages 18, the inner ends of the inlet passages 18 and the ports 17 lying in the same radial plane. The inlet passages 18 communicate with a circumferential groove 19 which is formed in the peripheral surface of the sleeve 11 and this communicates by way of an on/off valve 20, with the outlet of a fuel supply pump which is generally indicated at 21. The supply pump draws fuel from a fuel inlet not shown, and its output pressure is controlled by a valve also not shown.

The rotary part of the supply pump 21 is carried on a drive shaft 22 which is journalled in the body part and which in use, is driven from the associated engine. The drive shaft has a dished gear wheel 23 mounted thereon and has an enlarged head portion 24 which surrounds the end of the distributor member 12. The head portion defines a pair of slots 25 in which are located shoes 26 which at their inner ends engage the plungers 14 respectively and which at their outer ends are provided with grooves which carry rollers 27. In addition, located in the slots 25 are drive plates 28 which are connected to the distributor member. The drive plates transmit drive between the drive shaft 22 and the distributor member but at the same time allow axial movement of the distributor member.

The internal surface of the enlarged portion 24 of the shaft is flared outwardly and the shoes 26 are provided with complementary surfaces whereby the extent of outward movement of the plungers 14 will depend upon the axial setting of the distributor member.

The drive shaft 22 also defines a chamber in which is located a coiled compression spring 29 which acts upon the adjacent end of the distributor member to urge it as shown in the drawing, towards the right. A chamber 30 is defined in part by the end surface of the distributor member and in part by a cover 31, the cover having a skirt portion which locates over the reduced end portion of the sleeve 11. A fluid seal is defined between the cover 31 and the reduced end portion by means of a sealing ring whereby fuel under pressure in the groove 19 cannot enter the chamber directly.

The rollers 27 engage the internal peripheral surface of an angularly adjustable cam ring 32 on the internal peripheral surface of which are formed pairs of cam lobes. The lobes are positioned such that inward movement of the plungers 14 can only take place whilst the groove at the end of the passage 16 is in communication with an outlet 17. When the groove moves into register with an inlet passage 18, fuel is supplied to the bore 13 and the plungers 14 are moved outwardly. The extent of outward movement of the plungers is limited by the abutment of the surfaces on the shoes with the flared surface defined by the enlarged portion 24 of the drive shaft. The axial setting of the distributor member therefore determines the amount by which the plunger 14 can move outwardly and thereby the amount of fuel which is delivered by the apparatus at each delivery stroke. In the example as the distributor member is moved towards the right, the quantity of fuel which is delivered increases.

Formed in the distributor member is a passage 33 which opens into the chamber 30 at one end and which at its other end, communicates with a port 34 on the periphery of the distributor member. Moreover, mounted about the portion of the distributor between the sleeve 11 and the drive plate 28 is an axially movable sleeve 35. This is coupled to a governor mechanism which is generally indicated at 36 but which will be described in more detail below. In addition, a further passage 37 is formed in the distributor member and has one end in communication with the chamber 30. The other end of the passage 37 communicates with a radially disposed drilling 38 the ends of which open onto the periphery of the distributor member at a position to register with a port 39 formed in the sleeve and communicating with the aforesaid groove 19.

As the distributor member rotates and one end of the drilling 38 communicates with the port 39, fuel will flow through the drilling into the chamber 30 resulting in an increase in the pressure in the chamber. The increase in pressure will result in movement of the distributor member against the action of the spring 39 however, for a fixed axial setting of the sleeve 35, the port 34 will be exposed beyond the end of the sleeve by an increasing amount. As a result fuel will flow out of the chamber 30 and in practice, an equilibrium position is established with the sleeve and the distributor member, acting as a follow up servo system. The port 34 constitutes a variable orifice of a fluid potentiometer the fixed orifice of which is constituted by the drilling 38 and the port 39. The fact that these two items are of comparatively large diameter means that there is little chance of them becoming blocked by foreign matter during prolonged use of the apparatus.

As previously mentioned the axial setting of the sleeve 35 is determined by a governor 36. The governor comprises a centrifugal weight unit 40 the cage 41 of which is secured to an end face of a gear wheel 42 mounted about a shaft 43. The teeth of the gear wheel 42 mesh with the teeth of the gear wheel 23 and since the wheel 42 is smaller than the wheel 23 the cage will be driven at a speed greater than that of the drive shaft 22. The shaft 43 carries an axially movable sleeve 44 which is provided with a flange engaged by the toe portions of the weights 45 carried by the cage. As the speed increases the weights move outwardly and thereby impart axial movement to the sleeve 44. As shown the sleeve and the weight unit are shown in the rest position although, as will become apparent, the remaining portion of the governor mechanism is shown in the engine idling position.

The governor mechanism further includes a pivotally mounted channel shaped carried 46 and this is pivotally mounted within the body part by pivots, one of which is seen at 47 in FIG. 3 and the position of which is shown by the dotted circle in FIG. 1. The carrier is biassed in a clockwise direction as seen in FIG. 1, by means of a coiled compression spring 48, into contact with a stop 49 which is adjustable from exterior of the body part. The carrier supports two levers 50, 51 which are pivotally mounted about a pivot axis indicated at 52 in FIG. 1. Both levers are cranked and in the rest position, are separated from each other by means of a leaf spring 54. In the running position as shown, the sleeve 44 engages the lever 50 and overcomes the force exerted by the leaf spring 54. The lever 50 carries a projection 53 which is located in a recess in the sleeve 35 whereby as the lever 50 is moved angularly about the pivot axis 52, axial movement will be imparted to the sleeve.

The lever 51 extends upwardly beyond the end of the lever 50 and is engaged by one end of an idling spring 55 the other end of which is engaged with an abutment 56 which extends through an aperture not shown in the lever, and engages one end of a coiled tension spring 57 the other end of which is connected to an arm 58 adjustable from exterior of the apparatus. In operation, the spring 55 acts as an idling spring to resist the force exerted by the weights during engine idling. As the speed increases however the idling spring ceases to have any effect and the force developed by the weights is opposed by the action of the spring 57. As the force increases, the levers 50 and 51 are moved in the clockwise direction about the pivot 52 and the sleeve 35 is moved towards the left to cover the port 34. As a result the pressure in the chamber 30 increases and the distributor member also moves towards the left to reduce the amount of fuel supplied to the engine. The force exerted by the spring 57 can be adjusted by the operator of the engine to alter the governed speed if this is required. The governor in this case therefore acts as an "all speed" governor. If the spring 57 is a preloaded spring then the governor acts as a "two speed" governor. When the engine is at rest the levers 50 and 51 are separated by the spring 54 and the sleeve 35 is moved further to the right as seen in FIG. 1. As a result an increased quantity of fuel can be supplied by the apparatus for the purpose of starting the engine. As soon as the engine starts however the force exerted by the spring 54 is overcome and the quantity of fuel supplied to the engine is reduced.

The stop 49 determines the maximum amount of fuel which can be supplied by the apparatus to the engine at each delivery stroke. For example as seen in FIG. 1 if the carrier 46 is moved in the anti-clockwise direction, the sleeve 35 will move to the right thereby increasing the fuel delivered to the engine.

It is required that the timing of delivery of fuel to the associated engine should vary in accordance with the speed and the load on the associated engine. As shown in FIG. 2 therefore a piston 59 is provided and which engages a peg 60 carried by the cam ring 32. The piston is subjected at its outer end, to the pressure of fuel delivered by the supply pump 21 which pressure varies in accordance with the speed of operation of the apparatus. The movement of the cam ring under the action of the piston is opposed by a coiled compression spring 61. One end of the compression spring is engaged with an abutment 62 which engages the peg 60 whilst the other end of the spring is located against the base wall of a cup 63 in which the spring is located. The cup 63 is angularly movable within a bore formed in the body part and connected to the cup is a lever 64 which is in turn connected to the lever 58. The angular position of the cup 63 will therefore depend upon the demand placed upon the engine by the operator. Alternatively the setting of the lever 64 and therefore the angular setting of the cup 63 may be determined by the axial setting of the distributor member which provides a signal indicative of the amount of fuel supplied by the apparatus to the engine and therefore the load on the associated engine. The cup 63 may be connected to the distributor member by a suitable linkage or the lever 64 may be coupled to the lever 50 the angular position of which is representative of the axial position of the distributor member.

The angular setting of the cup 63 determines its axial setting, this being achieved by means of a pin 65 which engages with a shaped surface 66 on the base of the cup. As the load on the associated engine varies so also does the angular position of the cup and therefore the axial position thereof, this influencing the force exerted by the spring 61 in opposition to the force exerted by the piston, on the cam ring. Thus the timing of delivery of fuel varies in accordance with the speed of and the load on the associated engine.

In the example described, if the outlet pressure of the supply pump 21 should fall to a low value such for example as might occur if air is drawn into the inlet of the pump, the distributor member 12 will under the action of the spring 29, move towards the maximum fuel position. Even though the pressure falls there will still be enough pressure to cause fuel to be supplied to the bore 13 with the result that the amount of fuel supplied to the associated engine may increase. If the amount of fuel supplied to the engine increases its speed will increase and the speed may attain a dangerous value. In order to avoid this possibility the surfaces on the shoes 26 and the flared surface defined by the enlarged portion 24 of the drive shaft, can be inclined in the opposite direction so that as the distributor member is moved by the spring 29 the amount of fuel supplied to the associated engine will decrease.

In order for the apparatus to work as previously described it is necessary for the port 34 to be repositioned so that it is controlled by the right hand end of the sleeve.

Figure 4:
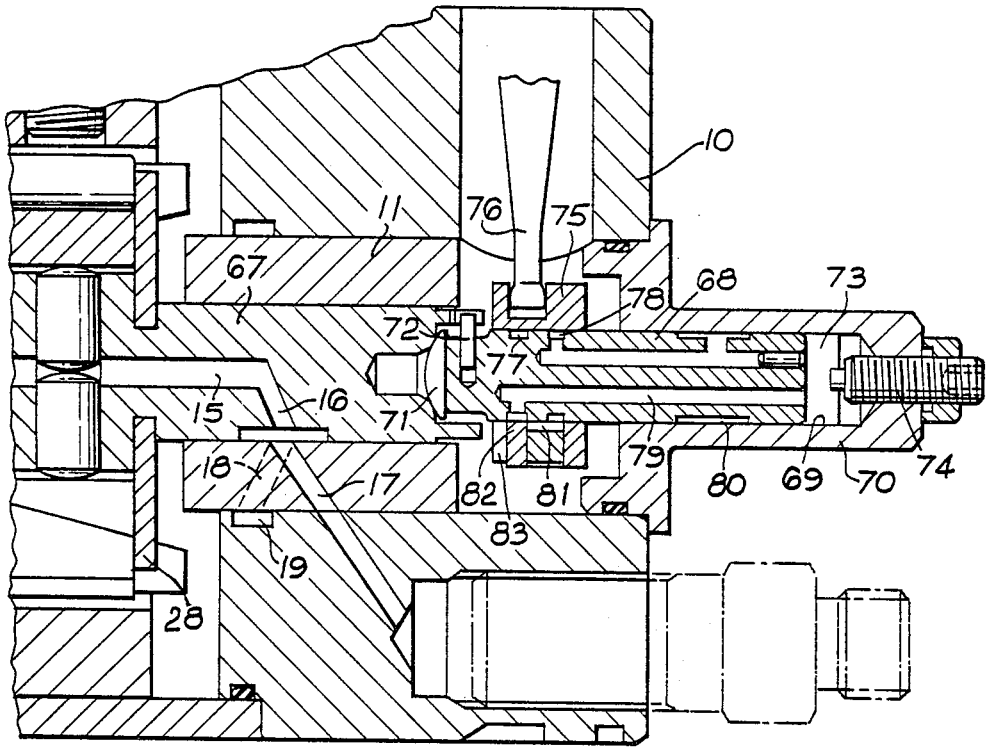
FIG. 4 is a part sectional side elevation of a modification of parts of the apparatus of FIG. 1.

With the arrangement described a considerable length of the distributor member is unsupported and this can lead to excessive wear and therefore a short woking life. The construction which is shown in FIG. 4 is therefore proposed. Turning to FIG. 4 the distributor member is shown at 67 and is supported for rotation in the sleeve 11. As in the example shown in FIG. 1, the sleeve defines the inlet passages 18, the groove 19 and the outlet ports 17. The distributor member incorporates the passages 15 and 16.

In order to move the distributor member 67 towards the left against the action of the spring a piston 68 is provided which is mounted for axial and angular movement in a bore 69 formed in an end closure member 70. The piston has at one end a half spherical thrust member 71 which engages a complementary surface defined in the end of the distribution member. A peg 72 is carried by the distributor member and extends outwardly and is located in a slot defined by an end portion of the distributor member so that the piston is rotated by the distributor member. The thrust member 71 takes up any slight misalignment of the piston and distributor member.

The end of the piston 68 is subjected to a pressure in a chamber 73 defined by the end of the bore 69 in the closure member 70. The closure member carries an adjustable end stop 74 to limit the movement of the distributor member under the action of the spring. Slidable on the piston is a sleeve 75 the axial setting of which is within the body 10 is controlled by a lever 76 which is equivalent to the lever 50 of the Examples of FIG. 1.

Formed in the piston 68 is a pair of axially spaced grooves 77,78. The groove 77 is in constant communication with the chamber 73 by way of a passage 79 and the groove 78 communicates with a groove 80 on the periphery of the piston. The groove 80 is in constant communication with the outlet of the pump 21. The sleeve has on its internal surface of land 82 on one side of which is an axial groove 81 which has an end wall. On the other side of the land 82 is an open ended groove 83. The groove 81 communicates with the groove 78 whilst the groove 83 is open to the space surrounding the sleeve 75 which space is at a low pressure. The axial width of the land 82 is just sufficient to cover the groove 77.

In operation, in the equilibrium position shown, the land covers the groove 77 so that the chamber 73 is hydraulically isolated. If the sleeve is moved towards the right the groove 77 will be exposed to the groove 83 and hence to the low pressure. As a result fuel can escape from the space 73 under the action of the force exerted by the spring which biases the distributor member. The distributor member will move towards the right until the equilibrium position is reached and the groove is again covered by the land 82. If the sleeve is moved to the left then the groove 77 is exposed to the groove 81 and therefore placed in communication with the groove 78. As a result fuel under pressure will be supplied to the chamber 73 and the distributor will move towards the left until the equilibrium position is reached and the groove 77 is again covered by the land 82. Thus the setting of the distributor member changes as the sleeve is moved.

As will be appreciated the length of distributor member which is unsupported is considerably reduced as compared with the construction shown in FIG. 1.

I claim:

1. A fuel injection pumping apparatus for supplying fuel to an internal combustion engine comprising a body part, a rotary distributor member located in the body part, an outwardly extending bore formed in the distributor member and a plunger located therein, means for feeding fuel to said bore to move the plunger outwardly during a filling stroke of the apparatus, a delivery passage communicating with the bore and arranged to register with an outlet port in the body part during a delivery stroke of the apparatus, a cam for imparting inward movement to the plunger to effect delivery of fuel, stop means for limiting the outward movement of the plunger and means for varying the axial setting of the distributor member, said stop means being arranged so that the amount of fuel delivered during the delivery stroke depends upon the axial setting of the distributor member, resilient means for biassing the distributor member in one axial direction, a variable volume chamber defined in part by an end face of the distributor member, said resilient means acting to urge the distributor member in a direction to reduce the volume of said chamber, an axially movable sleeve carried on said distributor member, said sleeve in conjunction with passage means in said distributor member which communicates with said chamber, acting to control the volume of liquid in said chamber, governor means operable to adjust the axial position of said sleeve, a low pressure pump for supplying liquid under pressure, a first passage for conveying liquid from the outlet of the pump to said chamber and said passage means comprising a second passage formed in the distributor member and in communication at one end with said chamber and at its other end with a port on the periphery of the distributor member, said port being positioned so that the flow of liquid therethrough is determined by the relative axial position of the sleeve and distributor member.

2. An apparatus according to claim 1 in which said first passage includes a further port in the distributor member and a drilling formed in the wall of a further sleeve in which the distributor member is located, said further port and drilling being brought into and out of register as the distributor member rotates.

3. A fuel injection pumping apparatus for supplying fuel to an internal combustion engine comprising a body part, a rotary distributor member located in the body part, an outwardly extending bore formed in the distributor member and a plunger located therein, means for feeding fuel to said bore to move the plunger outwardly during a filling stroke of the apparatus, a delivery passage communicating with the bore and arranged to register with an outlet port in the body part during a delivery stroke of the apparatus, a cam for imparting inward movement to the plunger to effect delivery of fuel, stop means for limiting the outward movement of the plunger and means for varying the axial setting of the distributor member, said stop means being arranged so that the amount of fuel delivered during the delivery stroke depends upon the axial setting of the distributor member, resilient means for biassing the distributor member in one axial direction, a variable volume chamber defined in part by an end face of a further member of cylindrical form coupled to the distributor member so as to rotate and be movable therewith, said resilient means acting to urge the distributor member in a direction to reduce the volume of said chamber, an axially movable sleeve carried on said further member, a passage in said further member which communicates with said chamber and which has an opening on the periphery of said further member, the relative axial position of the sleeve and said further member controlling the flow through said opening so that said sleeve in conjunction with said passage acts to control the volume of liquid in said chamber, and governor means operable to adjust the axial position of said sleeve.

4. An apparatus according to claim 3 in which said sleeve defines a land which in an equilibrium position covers said opening to prevent flow of liquid into and out of said chamber.

5. An apparatus according to claim 4 including first and second grooves defined in the sleeve on the opposite sides respectively of said land, said first groove being on the side of the land remote from the distributor member, passage means connecting said first groove with a source of liquid under pressure and said second groove communicating with a low pressure whereby when the sleeve is moved relative to the further member in a direction to place said opening in communication with said first groove liquid will flow to said chamber to urge the further member and the distributor member in a direction to follow the movement of the sleeve until the equilibrium position is reached, and when the sleeve is moved in the opposite direction the opening will be uncovered to said second groove to allow liquid to flow from said chamber and to allow the further member and distributor member to follow the movement of the sleeve until the equilibrium position is established.

6. An apparatus according to claim 5 including a further passage in the further member and through which liquid under pressure is supplied to said first groove, said further passage opening onto the periphery of said further member at a position to communicate with said first groove.

7. An apparatus according to claim 3 including a thrust member located between the distributor member and said further member, said thrust pad having a part spherical surface for engagement with a complementary surface on one of said members.

8. An apparatus according to any one of claims 1, 2, 4, 5, 6, 7 or 3 in which said governor means includes a centrifugal weight mounted in a cage adapted to be driven in synchronism with the distributor member, a first lever pivotally mounted intermediate its ends, one end of said first lever being connected to said sleeve whereby angular movement of the lever will impart axial movement to the sleeve, means engaged with said weight and with said first lever, the force exerted on said first lever acting to move the sleeve in a direction to reduce the amount of fuel supplied by the apparatus and spring means acting on said first lever in opposition to the force exerted by said weight.

9. An apparatus according to claim 8 including a second lever pivotally mounted about the same pivot as the first lever, said spring means acting on said second lever and further spring means acting between the two levers.

10. An apparatus according to claim 9 in which said further spring means comprises a leaf spring which is operative during starting of the associated engine to urge the first lever to a position to ensure an increased supply of fuel to the engine.

11. An apparatus according to claim 9, in which said spring means includes first and second springs connecting said second lever with an operator adjustable control, said first spring being a relatively light spring and being operative in conjunction with the weight, to control the idling speed of the associated engine, said second spring being operative to control at least the maximum speed of the engine.

12. An apparatus according to claim 8, including a carrier which mounts the pivot for said first lever, said carrier being pivotally mounted on the body part about an axis which is offset from the axis of the pivot of said first lever, whereby movement of the carrier about its pivot axis will effect axial movement of the sleeve and a stop for adjusting the setting of said carrier.

13. An apparatus according to claim 11, including means for adjusting the setting of said cam to vary the timing of delivery of fuel by the apparatus, said means including a fluid pressure operable piston the force exerted by which is opposed by a spring, the force exerted by the spring being adjustable in accordance with the load on the associated engine.

14. An apparatus according to claim 13 in which said spring is located within a cup-shaped member, the angular setting of the member being adjustable in accordance with the load on the engine, a cam surface defined on the cup-shaped member, and an abutment engageable with said cam surface whereby angular movement of the cup-shaped member will effect axial movement thereof to vary the force exerted by said spring.

15. An apparatus according to claim 14 in which said cup-shaped member is connected to said operator adjustable control.

16. An apparatus according to claim 14 in which said cup-shaped member is connected to the distributor member whereby axial movement of the distributor member will impart angular movement to the cup-shaped member.

* * * * *